US010750287B2

(12) United States Patent
Lippert et al.

(10) Patent No.: US 10,750,287 B2
(45) Date of Patent: Aug. 18, 2020

(54) EVACUATION OF LIQUID FROM ACOUSTIC SPACE

(71) Applicant: Apple Inc., Cupertino, CA (US)

(72) Inventors: Jesse A. Lippert, San Jose, CA (US); Nikolas T. Vitt, Sunnyvale, CA (US); Christopher Wilk, Los Gatos, CA (US); Rex T. Ehman, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/206,693

(22) Filed: Nov. 30, 2018

(65) Prior Publication Data

US 2019/0098415 A1 Mar. 28, 2019

Related U.S. Application Data

(63) Continuation of application No. 15/304,480, filed as application No. PCT/US2015/026705 on Apr. 20,
(Continued)

(51) Int. Cl.
*H04R 25/00* (2006.01)
*H04R 9/02* (2006.01)
(Continued)

(52) U.S. Cl.
CPC ..... *H04R 9/02* (2013.01); *H04R 1/023* (2013.01); *H04R 1/025* (2013.01); *H04R 1/24* (2013.01);
(Continued)

(58) Field of Classification Search
CPC combination set(s) only.
See application file for complete search history.

(56) References Cited

U.S. PATENT DOCUMENTS 3,987,258 A 10/1976 Tsutsui
4,868,799 A 9/1989 Massa
(Continued)

FOREIGN PATENT DOCUMENTS

CN 1462565 12/2003
CN 1642355 7/2005
(Continued)

OTHER PUBLICATIONS

Consumerist, "Cellphone Battery Designed to Fail at First Drop of Water?" Consumerist, Sep. 22, 2007 (Sep. 22, 2007), XP055199652, Retrieved from the Internet: URL:http://consumerist.com/2007/09/22/cellphone-battery-designed-to-fail-at-first-drop-of-water/ [retrieved on Jul. 2, 2015], 4 pages.
(Continued)

*Primary Examiner* — Amir H Etesam
(74) *Attorney, Agent, or Firm* — Brownstein Hyatt Farber Schreck, LLP

(57) ABSTRACT

An acoustic module, such as a microphone or speaker module, includes an acoustic membrane that vibrates to produce acoustic waves and an acoustic cavity through which acoustic waves produced by the membrane travel. A liquid removal mechanism removes liquid from the acoustic cavity. Such a liquid removal mechanism may include the acoustic membrane, heating elements, hydrophobic and/or hydrophilic surfaces, and so on. In some cases, the liquid removal mechanism may remove liquid from the acoustic cavity upon connection of the acoustic module and/or an associated electronic device to an external power source.

20 Claims, 6 Drawing Sheets

Related U.S. Application Data

2015, now abandoned, which is a continuation of application No. 14/498,221, filed on Sep. 26, 2014, now Pat. No. 9,226,076.

(60) Provisional application No. 61/986,302, filed on Apr. 30, 2014.

(51) Int. Cl.

| | |
|---|---|
| ***H04R 1/02*** | (2006.01) |
| ***H04R 1/44*** | (2006.01) |
| ***H04R 3/00*** | (2006.01) |
| ***H04R 1/24*** | (2006.01) |
| ***H04R 29/00*** | (2006.01) |
| *H04R 7/08* | (2006.01) |
| *H04R 7/12* | (2006.01) |

(52) U.S. Cl.

CPC ..... *H04R 1/44* (2013.01); *H04R 3/007* (2013.01); *H04R 29/001* (2013.01); *H04R 7/08* (2013.01); *H04R 7/122* (2013.01); *H04R 2209/00* (2013.01); *H04R 2499/11* (2013.01); *H04R 2499/15* (2013.01)

(56) References Cited

U.S. PATENT DOCUMENTS

| | | | |
|---|---|---|---|
| 5,117,403 | A | 5/1992 | Eberl et al. |
| 5,349,140 | A | 9/1994 | Valenzin |
| 5,812,496 | A | 9/1998 | Peck |
| 6,007,105 | A | 12/1999 | Dietle et al. |
| 6,064,909 | A | 5/2000 | Barkley et al. |
| 6,128,394 | A | 10/2000 | Hayakawa |
| 6,486,398 | B1 | 11/2002 | McCulloch |
| 6,729,184 | B2 | 5/2004 | Tsukada et al. |
| 6,745,626 | B2 | 6/2004 | Usui et al. |
| 6,785,395 | B1 | 8/2004 | Ameson |
| 6,899,794 | B1 | 5/2005 | Yamada |
| 6,932,187 | B2 | 8/2005 | Banter et al. |
| 7,128,387 | B2 | 10/2006 | Takiguchi |
| 7,245,733 | B2 | 7/2007 | Saltykov |
| 7,480,209 | B2 | 1/2009 | Giles |
| 7,499,561 | B2 | 3/2009 | Hanses et al. |
| 7,577,345 | B2 | 8/2009 | Tei et al. |
| 7,707,877 | B2 | 5/2010 | Nishizu et al. |
| 7,876,919 | B2 | 1/2011 | Ram et al. |
| 7,894,621 | B2 | 2/2011 | Jensen |
| 7,991,173 | B2 | 8/2011 | Ueki |
| 8,055,003 | B2 | 11/2011 | Mittleman et al. |
| 8,059,490 | B2 | 11/2011 | Rapps et al. |
| 8,112,130 | B2 | 2/2012 | Mittleman et al. |
| 8,135,149 | B2 | 3/2012 | Yoshida et al. |
| 8,157,048 | B2 | 4/2012 | Banter et al. |
| 8,165,308 | B2 | 4/2012 | Norhammar et al. |
| 8,170,266 | B2 | 5/2012 | Hopkinson et al. |
| 8,175,321 | B2 | 5/2012 | Bryant et al. |
| 8,185,166 | B2 | 5/2012 | Weber et al. |
| 8,220,142 | B2 | 7/2012 | Lim |
| 8,229,153 | B2 | 7/2012 | Mittleman et al. |
| 8,233,646 | B2 | 7/2012 | Lutz |
| 8,272,517 | B2 | 9/2012 | Horie et al. |
| 8,416,089 | B1 | 4/2013 | Clary |
| 8,638,970 | B2 | 1/2014 | Burton |
| 8,644,530 | B2 | 2/2014 | Soininen et al. |
| 8,670,586 | B1 | 3/2014 | Boyle et al. |
| 8,687,828 | B2 | 4/2014 | Otani et al. |
| 8,724,841 | B2 | 5/2014 | Bright et al. |
| 8,792,665 | B2 | 7/2014 | Lin |
| 8,803,745 | B2 | 8/2014 | Dabov |
| 8,811,634 | B2 | 8/2014 | Kaplan et al. |
| 8,883,289 | B2 | 11/2014 | Tsao et al. |
| 8,923,528 | B2 | 12/2014 | Arche |
| 8,939,252 | B2 | 1/2015 | Sanborn |
| 8,942,401 | B2 | 1/2015 | Murayama |
| 8,965,030 | B2 | 2/2015 | Aase |
| 8,986,802 | B2 | 3/2015 | Karube et al. |
| 9,038,773 | B2 | 5/2015 | Banter |
| 9,078,063 | B2 | 7/2015 | Loeppert et al. |
| 9,132,270 | B2 | 9/2015 | Vaishya |
| 9,171,535 | B2 | 10/2015 | Abe et al. |
| 9,226,076 | B2 | 12/2015 | Lippert et al. |
| 9,253,297 | B2 | 2/2016 | Abe et al. |
| 9,258,659 | B2 | 2/2016 | Pan et al. |
| 9,271,070 | B2 | 2/2016 | Abe et al. |
| 9,317,068 | B2 | 4/2016 | Sanders |
| 9,363,587 | B2 | 6/2016 | Weiss et al. |
| 9,363,589 | B2 | 6/2016 | Lippert et al. |
| 9,414,141 | B2 | 8/2016 | Cohen et al. |
| 9,461,605 | B2 | 10/2016 | Sekiyama |
| 9,497,529 | B2 | 11/2016 | Jeziorek et al. |
| 9,575,392 | B2 | 2/2017 | Hooton et al. |
| 9,648,432 | B2 | 5/2017 | Pan et al. |
| 9,681,210 | B1 | 6/2017 | Lippert et al. |
| 9,820,038 | B2 | 11/2017 | Salvatti et al. |
| 9,980,026 | B2 | 5/2018 | Zadesky et al. |
| 2004/0029530 | A1 | 2/2004 | Noguchi et al. |
| 2005/0134473 | A1 | 6/2005 | Jang et al. |
| 2006/0045301 | A1 | 3/2006 | Jakubaitis |
| 2006/0198547 | A1 | 9/2006 | Hampton |
| 2007/0035865 | A1 | 2/2007 | Chashi |
| 2007/0113964 | A1 | 5/2007 | Crawford et al. |
| 2007/0263878 | A1 | 11/2007 | Yu |
| 2008/0149417 | A1 | 6/2008 | Dinh |
| 2009/0230487 | A1 | 9/2009 | Saitoh et al. |
| 2011/0013799 | A1 | 1/2011 | Fang et al. |
| 2011/0298184 | A1 | 12/2011 | Aurelius |
| 2011/0317868 | A1 | 12/2011 | Tsujii |
| 2012/0177239 | A1 | 7/2012 | Lee |
| 2012/0195455 | A1 | 8/2012 | Chiba et al. |
| 2013/0335211 | A1 | 12/2013 | Kobayashi |
| 2014/0064546 | A1 | 3/2014 | Szczech |
| 2014/0093095 | A1 | 4/2014 | Slotte et al. |
| 2014/0369547 | A1 | 12/2014 | Qingshan |
| 2015/0016648 | A1 | 1/2015 | Kazemzadeh et al. |
| 2015/0029112 | A1 | 1/2015 | Macours |
| 2015/0146905 | A1 | 5/2015 | Abe et al. |
| 2015/0304767 | A1 | 10/2015 | Mori |
| 2016/0205469 | A1 | 7/2016 | Steijner et al. |
| 2016/0241945 | A1* | 8/2016 | Zadesky ..... H04R 29/00 |
| 2017/0041712 | A1 | 2/2017 | Lippert et al. |
| 2017/0227498 | A1 | 8/2017 | Miller et al. |
| 2017/0227499 | A1 | 8/2017 | Miller et al. |
| 2017/0371616 | A1 | 12/2017 | Su et al. |
| 2018/0058918 | A1 | 3/2018 | Vitt et al. |
| 2018/0262840 | A1 | 9/2018 | Lippert et al. |

FOREIGN PATENT DOCUMENTS

| | | |
|---|---|---|
| CN | 1933679 | 3/2007 |
| CN | 101084586 | 12/2007 |
| CN | 101268716 | 9/2008 |
| CN | 201210732 | 3/2009 |
| CN | 101467468 | 6/2009 |
| EP | 1079664 | 2/2001 |
| EP | 1998591 | 12/2008 |
| JP | 2004312156 | 11/2004 |
| JP | 2011188191 | 9/2011 |
| JP | 2013115549 | 6/2013 |
| WO | WO 04/043113 | 5/2004 |
| WO | WO 11/125804 | 10/2011 |
| WO | WO 15/047378 | 4/2015 |

OTHER PUBLICATIONS

The Gadget Show, "What to do when gadgets get wet," Retrieved from the Internet: URL:http://gadgetshow.channel5.com/gadget-show/blog/what-to-do-when-gadgets-get-wet [retrieved on Apr. 9, 2014], p. 2, paragraph 1, 2 pages.

(56) References Cited

OTHER PUBLICATIONS

Nakano et al., "Helmholtz resonance technique for measuring liquid volumes under micro-gravity conditions," *Microgravity Sci. Technol.*, XVII-3, 2005, pp. 64-70.

* cited by examiner

EVACUATION OF LIQUID FROM ACOUSTIC SPACE

CROSS-REFERENCE TO RELATED APPLICATIONS

This application is a continuation of U.S. patent application Ser. No. 15/304,480, filed Oct. 14, 2016, now abandoned, which is a 371 application of PCT/US2015/026705, filed Apr. 30, 2015, which is a Patent Cooperation Treaty patent application which claims priority to U.S. Non-Provisional application Ser. No. 14/498,221, filed Sep. 26, 2014, now U.S. Pat. No. 9,226,076, and U.S. Provisional Patent Application No. 61/986,302, filed Apr. 30, 2014, the entireties of which are incorporated herein by reference as if fully disclosed herein.

TECHNICAL FIELD

This disclosure relates generally to acoustic modules, and more specifically to evacuation of liquid from an acoustic space of an acoustic module.

BACKGROUND

Many acoustic modules, such as microphones or speakers, utilize an acoustic membrane to either produce or receive sound. For example, the acoustic membrane of a speaker module may vibrate to produce sound waves that travel into an external environment. However, as the sound waves produced by such an acoustic membrane must be able to travel to the external environment, liquids from the external environment may be able to enter the speaker module and interfere with and/or damage sensitive components. Similarly, the acoustic membrane of a microphone module may need to be exposed to an external environment in order to receive sound waves.

In some implementations, various components of such acoustic modules may be made resistant to water and/or other liquids in order to protect sensitive components. However, even when such components are made resistant to liquids, the presence of such liquids may interfere with acoustic operation. For example, the presence of liquid in an acoustic cavity through which acoustic waves must travel either to or from an acoustic membrane may hinder acoustic membrane vibration. Such hindrance may impede proper operation of such an acoustic module even when damage from such liquids is prevented.

SUMMARY

The present disclosure discloses systems, methods, and apparatuses for evacuating liquid from an acoustic space. An acoustic module, such as a microphone or speaker module, may include an acoustic membrane that vibrates to produce acoustic waves and an acoustic cavity through which acoustic waves produced by the membrane travel. A liquid removal mechanism may remove liquid from the acoustic cavity.

In various implementations, the liquid removal mechanism may include the acoustic membrane, which may produce one or more acoustic signals to force the liquid from the acoustic cavity. Such acoustic signal may be outside the acoustic range audible to humans.

In some cases, one or more sensors may detect the presence of liquid in the acoustic cavity. In such cases, the liquid removal mechanism may cause the acoustic membrane to produce a first acoustic signal, determine that the liquid is still present in the acoustic cavity, and cause the acoustic membrane to produce a second acoustic signal. In various implementations of such cases, the produced acoustic signal may be one that was previously produced to successfully force other liquid from the acoustic cavity at a previous time.

In one or more implementations, a screen element, such as a mesh, may separate the acoustic cavity from an external environment. The screen element may resist entry of liquids from the external environment into the acoustic cavity. In some cases, the screen element may be configured with one or more hydrophobic surfaces, such as one or more hydrophobic coatings. In various cases, an external surface of the screen element may be configured to be hydrophobic and an internal surface of the screen element may be configured to be hydrophilic, such as utilizing one or more hydrophobic and/or hydrophilic coatings. In other cases, the screen element may be configurable between a hydrophobic and a hydrophilic state. Such configuration may be based on the application of an electrical field. Various surfaces of the acoustic cavity may also be coated with one or more hydrophobic coatings.

In some implementations, the liquid removal element may include one or more heating elements that aid in evaporation of the liquid. In some cases, a voice coil may be coupled to the acoustic membrane and current may be applied to the voice coil to cause the voice coil to heat and act as the heating element. Such application of current may apply a direct current to perform heating as opposed to an alternating current voltage when vibrating the acoustic membrane utilizing the voice coil.

In one or more cases, detection of liquid in the acoustic cavity and/or removal of the liquid may be performed upon connection of the acoustic module and/or an electronic device in which the acoustic module is incorporated is connected to an external power source. In some cases, such an external power source may be a docking station, a wall outlet, and/or other such external power source.

In various implementations, an acoustic module may include an acoustic membrane that vibrates to produce acoustic waves, an acoustic cavity through which acoustic waves produced by the acoustic membrane travel, and at least one liquid removal mechanism that removes liquid from the acoustic cavity.

In one or more implementations, an electronic device may include a housing with at least one acoustic port and an acoustic module coupled to the at least one acoustic port. The acoustic module may include an acoustic membrane that vibrates to produce acoustic waves, an acoustic cavity through which acoustic waves produced by the acoustic membrane travel, and at least one liquid evacuation mechanism that removes liquid from the acoustic cavity.

In some implementations, a method for evacuating liquid from an acoustic space may include determining that liquid is present in an acoustic cavity of an acoustic module through which acoustic waves produced by an acoustic membrane of the acoustic module travel and removing the liquid from the acoustic cavity utilizing at least one liquid removal mechanism of the acoustic module.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure.

Together, the descriptions and the drawings serve to explain the principles of the disclosure.

DETAILED DESCRIPTION

Figure 1:
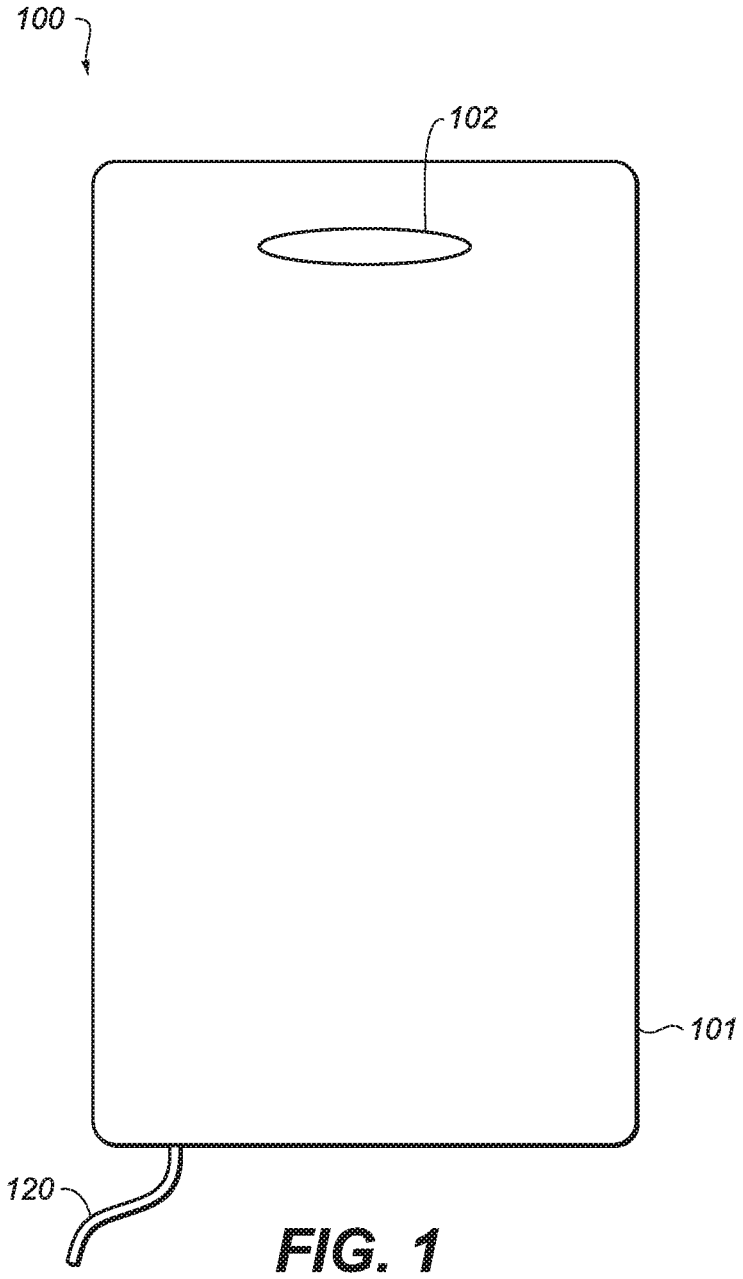
FIG. 1 is a front plan view of a system for evacuating liquid from an acoustic space.

The description that follows includes sample systems, methods, and computer program products that embody various elements of the present disclosure. However, it should be understood that the described disclosure may be practiced in a variety of forms in addition to those described herein.

The present disclosure discloses systems, methods, and apparatuses for evacuating liquid from an acoustic space. An acoustic module, such as a microphone or speaker module, may include an acoustic membrane that vibrates to produce acoustic waves and an acoustic cavity through which acoustic waves produced by the membrane travel. A liquid removal mechanism may remove liquid from the acoustic cavity.

In various implementations, the liquid removal mechanism may include the acoustic membrane, which may produce one or more acoustic signals to force the liquid from the acoustic cavity. Such acoustic signal may be outside the acoustic range audible to humans, which may be between 20 Hz and 20,000 Hz, although in some embodiments the signal may be within this range.

In some cases, one or more sensors may detect the presence of liquid in the acoustic cavity. In such cases, the liquid removal mechanism may cause the acoustic membrane to produce a first acoustic signal, determine that the liquid is still present in the acoustic cavity, and cause the acoustic membrane to produce a second acoustic signal. In various implementations of such cases, the produced acoustic signal may be one that was previously produced to successfully force other liquid from the acoustic cavity at a previous time, and/or may be based on an estimate of how much liquid remains within the cavity.

In one or more implementations, a screen element, such as a mesh, may separate the acoustic cavity from an external environment. The screen element may resist entry of liquids from the external environment into the acoustic cavity. In some cases, the screen element may be configured with one or more hydrophobic surfaces, such as one or more hydrophobic coatings (such as manganese oxide polystyrene, zinc oxide polystyrene, precipitated calcium carbonate, carbon-nanotubes, silica nano-coating, polytetrafluoroethylene, silicon, and so on). In various cases, an external surface of the screen element may be configured to be hydrophobic and an internal surface of the screen element may be configured to be hydrophilic, such as utilizing one or more hydrophobic and/or hydrophilic coatings (such as poly ethylene glycol and so on). In other cases, the screen element may be configurable between a hydrophobic and a hydrophilic state. Such configuration may be based on the application of an electrical field, such as utilizing the technique of electrowetting. Various surfaces of the acoustic cavity may also be coated with one or more hydrophobic coatings.

In some implementations, the liquid removal element may include one or more heating elements that aid in evaporation of the liquid. In some cases, a voice coil may be coupled to the acoustic membrane and current may be applied to the voice coil to cause the voice coil to heat and act as the heating element. Such application of current may apply a direct current to perform heating as opposed to an alternating current voltage when vibrating the acoustic membrane utilizing the voice coil.

In one or more cases, detection of liquid in the acoustic cavity and/or removal of the liquid may be performed upon connection of the acoustic module and/or an electronic device in which the acoustic module is incorporated is connected to an external power source. In some cases, such an external power source may be a docking station, a wall outlet, and/or other such external power source.

FIG. 1 is a front plan view of a system 100 for evacuating liquid from an acoustic space. As illustrated, the system includes an electronic device 101 that includes an acoustic port 102 and is connected to an external power source 120. As illustrated, the electronic device is a smart phone. However, it is understood that this is an example and that the electronic device may be any kind of electronic device (such as a laptop computer, a desktop computer, a cellular phone, a digital media player, a wearable device, a tablet computer, a mobile computer, a telephone, and/or other electronic device) without departing from the scope of the present disclosure. Further, the external power source is illustrated as a wall outlet power cord. However, it is understood that this is an example and that the external power source (such as a docking station or other external power source) without departing from the scope of the present disclosure.

Figure 2:
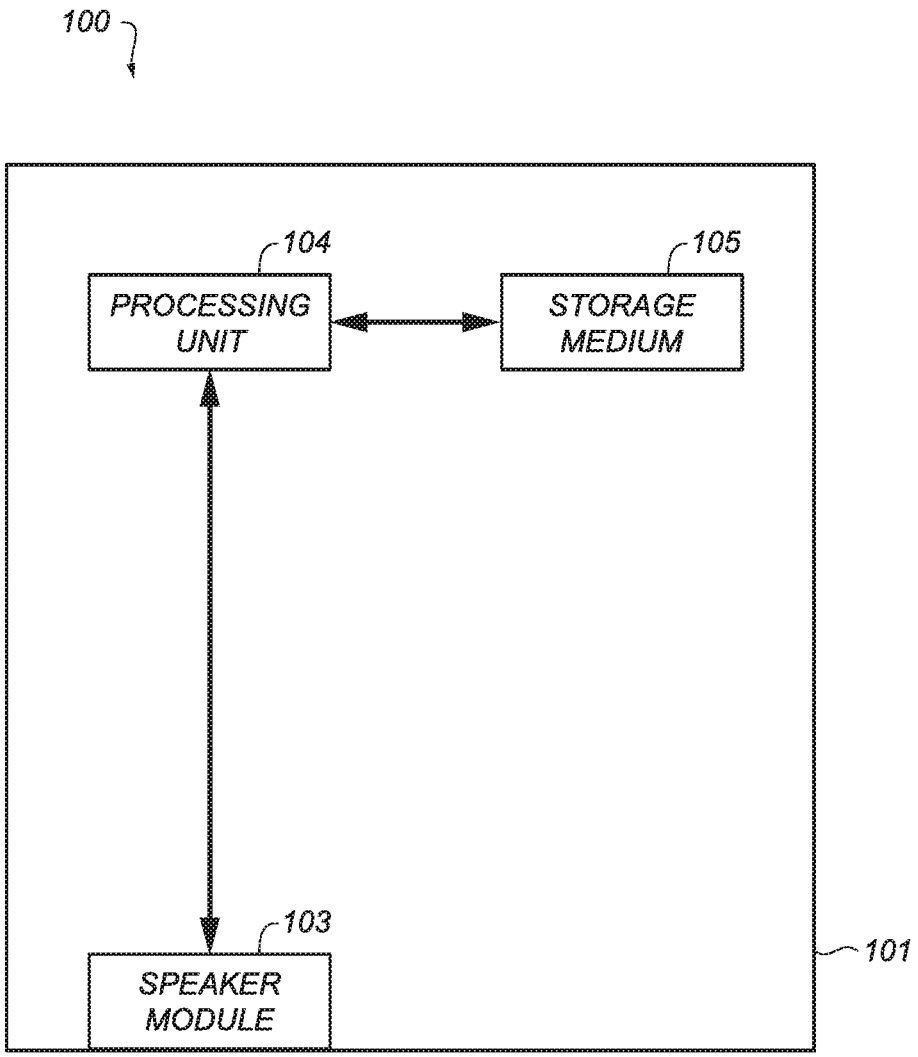
FIG. 2 is a block diagram illustrating example functional components of the system of FIG. 1.

FIG. 2 is a block diagram illustrating example functional components of the system 100 of FIG. 1. The electronic device 101 may include one or more processing units 104, one or more speaker modules 103, and/or one or more non-transitory storage media 105 (which may take the form of, but is not limited to, a magnetic storage medium; optical storage medium; magneto-optical storage medium; read only memory; random access memory; erasable programmable memory; flash memory; and so on). The processing unit may execute one or more instructions stored in the non-transitory storage medium in order to perform one or more electronic device functions.

Although FIG. 2 illustrates the electronic device 101 as including particular components, it is understood that this is an example. In various implementations, the electronic device may include additional components beyond those shown and/or may not include some components shown without departing from the scope of the present disclosure.

Further, although the electronic device 101 is illustrated in FIG. 2 and described above as including a speaker module 103, it is understood that this is an example. In various implementations, the module may be any kind of acoustic module such as a speaker module, a microphone module, and so on.

Figure 3A:
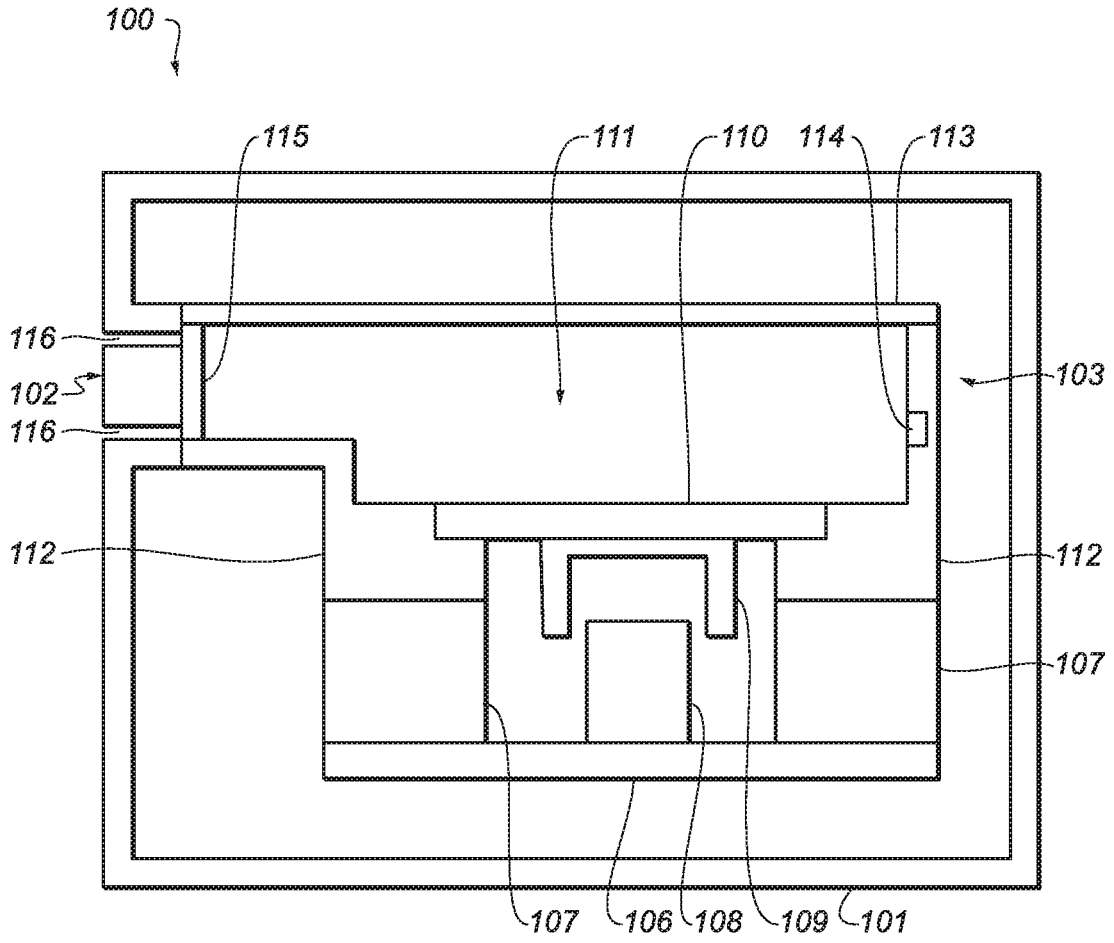
FIG. 3A is a cross-sectional side view of a first embodiment of an acoustic module included in an electronic device of the system of FIG. 1.

FIG. 3A is a cross-sectional side view of a first embodiment of an acoustic module 103 included in an electronic device 101 of the system 100 of FIG. 1. The electronic device may include a housing in which the acoustic port 102 is formed. Passages 116 of the acoustic port may connect the acoustic cavity 111 of the acoustic module to an environment external to the electronic device. A screen element 115 may separate the acoustic cavity from the external environment and may function to resist entry of liquids from the external environment into the acoustic cavity.

As illustrated, the acoustic module 103 may be a speaker module in various implementations. Such a speaker module may include an acoustic membrane 110, a voice coil 109, a center magnet 108, side magnets 107, a yoke 106, connector elements 112, and a cover 113. Generation of magnetic flux by the center magnet, side magnets, and yoke may cause the voice coil to move. Such movement may vibrate the acoustic membrane, producing acoustic waves that travel through the acoustic cavity 111 out through the acoustic port 102 to an environment external to the electronic device 101.

Figure 3B:
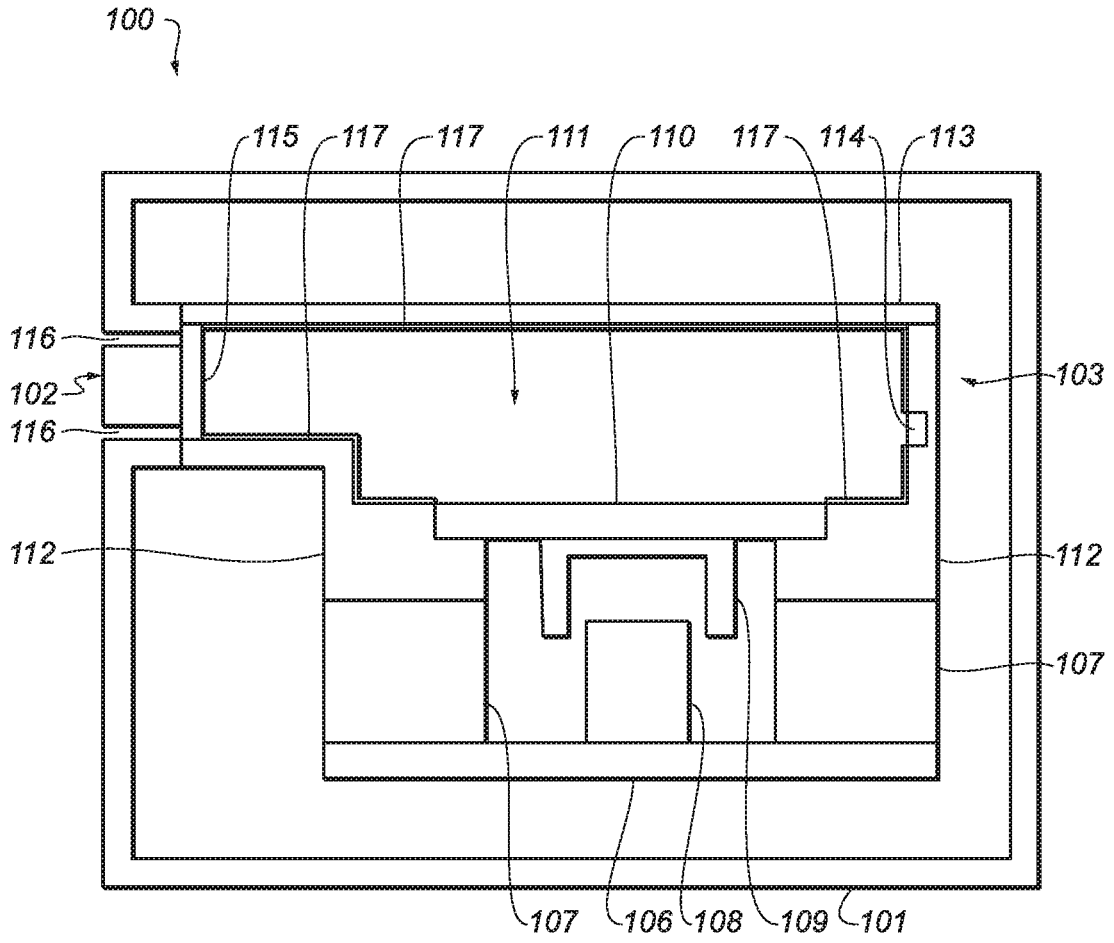
FIG. 3B is a cross-sectional side view of a second embodiment of an acoustic module included in an electronic device of the system of FIG. 1.

In various implementations, one or more liquid removal mechanisms may remove liquid from the acoustic cavity 111. Such mechanisms may include the participation of the acoustic membrane 110, the voice coil 109, one or more sensors 114, the screen element 115, one or more coatings (see FIGS. 3B and 3C), and/or other components.

In various implementations, the liquid removal mechanism may include the acoustic membrane 110. In such implementations, the acoustic membrane may produce one or more acoustic signals to force the liquid from the acoustic cavity 111.

Such acoustic signal may be outside the acoustic range audible to humans. The average acoustic range audible to humans may be between 20 Hz and 20,000 Hz. Thus, such an acoustic signal may be below 20 Hz or above 20,000 Hz. If such an acoustic signal is not audible to humans, a user may be unaware when such an acoustic signal is utilized to remove liquid from the acoustic cavity 111.

In some cases, one or more sensors 114 may detect the presence of liquid in the acoustic cavity. In such cases, the liquid removal mechanism may cause the acoustic membrane to produce a first acoustic signal, determine that the liquid is still present in the acoustic cavity (such as utilizing the sensor 114, which may be a pressure sensor, a liquid sensor, a moisture sensor, a water sensor, an acoustic sensor that determines that the acoustic membrane 110 is hindered by liquid by measuring acoustic waves produced and/or received by the acoustic membrane and comparing to those that should have been produced and/or received, and/or other kind of sensor capable of detecting liquid in the acoustic cavity), and cause the acoustic membrane to produce a second acoustic signal.

In various implementations of such cases, the produced acoustic signal may be one that was previously produced to successfully force other liquid from the acoustic cavity at a previous time. Such a procedure may enable the immediate utilization of an acoustic signal that is specifically tailored to the acoustic resonances of the acoustic module 103 and/or the acoustic cavity 111 for driving liquid from the acoustic cavity.

In some implementations, the liquid removal mechanism may include the screen element 115. Such implementations may include configuring the screen element with one or more hydrophobic and/or hydrophilic surfaces.

In some cases, the screen element 115 may be configured with one or more hydrophobic surfaces, such as one or more hydrophobic coatings (such as manganese oxide polystyrene, zinc oxide polystyrene, precipitated calcium carbonate, carbon-nanotubes, silica nano-coating, polytetrafluoroethylene, silicon, and so on). Such hydrophobic surfaces may resist the passage of liquids through the screen element in one or more directions.

Figure 3C:
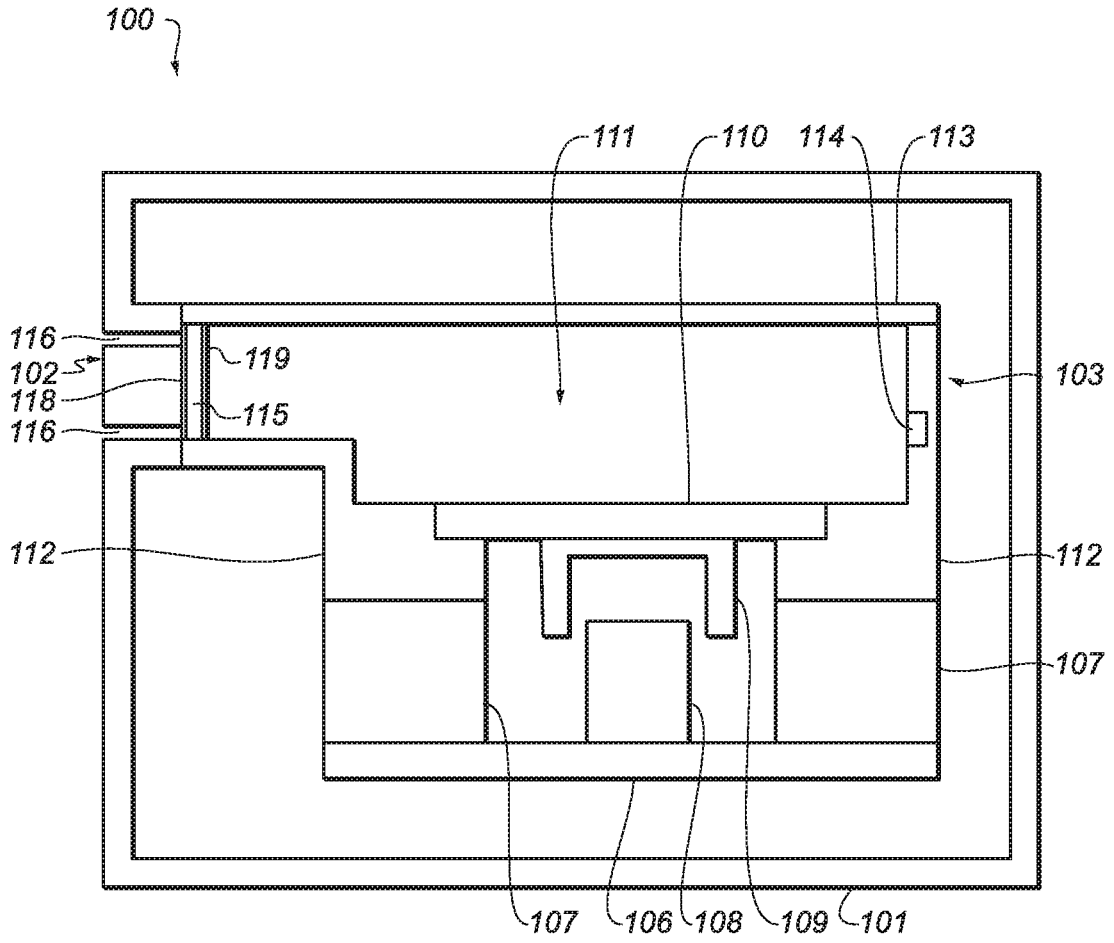
FIG. 3C is a cross-sectional side view of a third embodiment of an acoustic module included in an electronic device of the system of FIG. 1.

In various cases, an external surface of the screen element 115 may be configured to be hydrophobic and an internal surface of the screen element may be configured to be hydrophilic, such as utilizing one or more hydrophobic (see the hydrophobic coating 118 of FIG. 3C) and/or hydrophilic coatings (such as polyethylene glycol and so on) (see the hydrophilic coating 119 of FIG. 3C). Such hydrophobic external surfaces may resist the passage of liquids through the screen element from the external environment into the acoustic cavity 111 whereas such hydrophilic internal surfaces may aid the passage of liquids through the screen element from the acoustic cavity to the external environment.

In other cases, the screen element 115 may be configurable between a hydrophobic and a hydrophilic state. Such configuration may be based on the application of an electrical field, such as utilizing the technique of electrowetting. In such a case, the screen element may be configured in the hydrophobic state to resist the passage of liquids through the screen element from the external environment into the acoustic cavity 111 and in the hydrophilic state to aid the passage of liquids through the screen element from the acoustic cavity to the external environment.

In some cases, the liquid removal mechanism may include surfaces of the acoustic cavity 111. In such implementations, various surfaces of the acoustic cavity may be coated with one or more hydrophobic coatings (such as the hydrophobic coating 117 of FIG. 3B). Such hydrophobic surfaces may aid the passage of liquids from the acoustic cavity to the external environment.

In some implementations, the liquid removal element may include one or more heating elements that aid in evaporation of the liquid. In some cases, current may be applied to the voice coil 109 to cause the voice coil to heat and act as the heating element to aid in evaporating liquid in the acoustic cavity 111. Such application of voltage may apply a direct current to perform heating as opposed to an alternating current utilized when vibrating the acoustic membrane 110 utilizing the voice coil. Direct current applied to the voice coil may generate more heat in a shorter amount of time than alternating current. Further, greater amounts of current may be applied to the voice coil when utilizing the voice coil as a heating element than when utilizing the voice coil to vibrate the acoustic membrane.

In one or more cases, detection of liquid in the acoustic cavity and/or removal of the liquid may be performed upon connection of the acoustic module 103 and/or an electronic device 101 is connected to an external power source (such as the external power source 120 of FIG. 1). In some cases, such an external power source may be a docking station, a wall outlet, and/or other such external power source.

Although a variety of different liquid removal mechanisms are discussed above and illustrated in the accompanying figures, it is understood that these are examples. In various implementations, one or more of the discussed liquid removal mechanisms may be utilized in a single embodiment without departing from the scope of the present disclosure.

Further, although the electronic device 101 is illustrated and discussed as including a processing unit 104 and a non-transitory storage medium and the acoustic module 103 is not shown as including such components, it is understood that this is an example. In various implementations, the acoustic module may include a variety of additional components such as a controller that controls the acoustic membrane 110, the hydrophobic and/or hydrophilic state of the screen element 115, and/or other components to remove liquid from the acoustic cavity 111.

Figure 4:
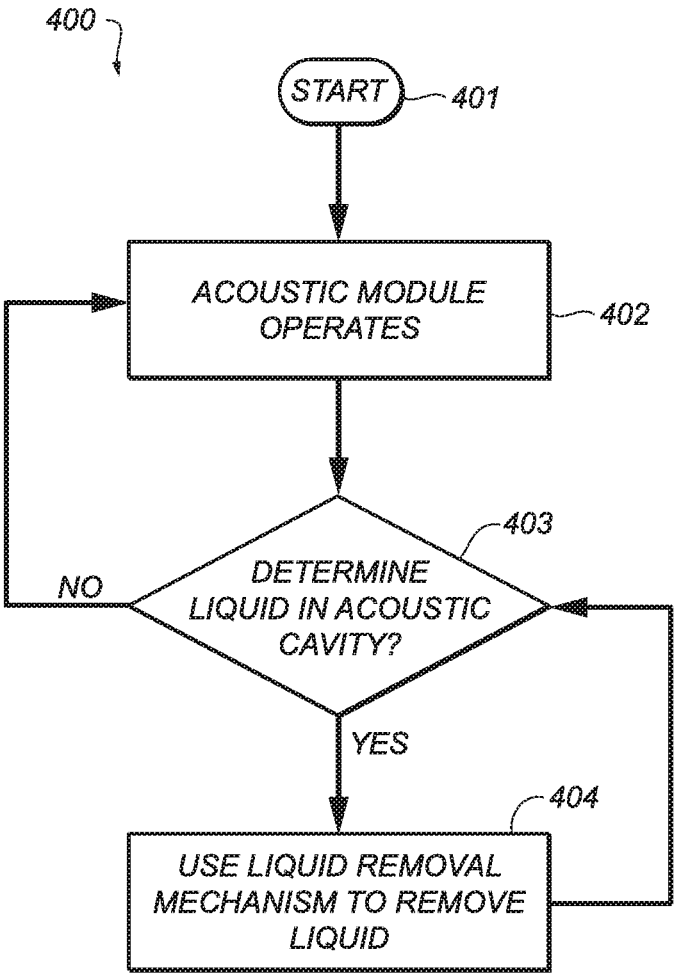
FIG. 4 is a flow chart illustrating a method for evacuating liquid from an acoustic space. This method may be performed by the system of FIG. 1 and/or the acoustic module of FIGS. 2 and 3A-3C.

FIG. 4 is a flow chart illustrating a method 400 for evacuating liquid from an acoustic space. This method may be performed by the system of FIG. 1 and/or the acoustic module of FIGS. 2 and 3.

The flow begins at block 401 and proceeds to block 402 where an acoustic module operates. The flow then proceeds to block 403 where it is determined whether or not liquid is present in an acoustic cavity of the acoustic module. Such determination may be performed utilizing one or more sensors. As one example, a tone having known characteristics may be played by the speaker. A microphone within or associated with the device may receive the tone, and a processor may determine if certain characteristics (volume, frequency, amplitude, audio components such as bass and treble, and so forth) are different than expected. The presence of water in the acoustic cavity may cause such differences, and the delta between the expected characteristic and received/determined characteristic may be correlated to an amount of water still in the acoustic chamber and/or a location of such water.

If water remains and is detected, the flow proceeds to block 404. Otherwise, the flow returns to block 402 where the acoustic module continues to operate.

At block 404, after it is determines that liquid is present in the acoustic cavity of the acoustic module, one or more liquid removal mechanisms attempt to remove the liquid from the acoustic cavity. The mechanism attempted may vary with the determination of how much water remains and/or where the water remains that was discussed with respect to block 403. For example, an acoustic signal having different acoustic characteristics may be played insofar as certain characteristics of that signal may make the signal more advantageous for removing the remaining volume of liquid. The flow then returns to block 403 where it is determined whether or not the liquid is still present in the acoustic cavity.

Although the method is illustrated and described above as including particular operations performed in a particular order, it is understood that this is an example. In various implementations, various configurations of the same, similar, and/or different operations may be performed without departing from the scope of the present disclosure.

By way of a first example, the method 400 is illustrated and described as attempting to remove liquid from the acoustic cavity anytime such is detected as present. However, in various implementations, removal of liquid may only be performed when the acoustic module and/or an electronic device into which the acoustic module is incorporated is connected to an external power source.

By way of a second example, the method 400 is illustrated and described as attempting to remove liquid from the acoustic cavity anytime such is detected as present. However, in various implementations, liquid removal mechanisms may operate before and/or after detection of liquid in the acoustic cavity. In some cases, the acoustic cavity may be coated with one or more hydrophobic coatings that function to aid liquid in leaving the acoustic cavity whenever liquid enters. Further, in some such cases, detection of liquid in the acoustic cavity may trigger an acoustic membrane to produce an acoustic signal to drive the liquid from the acoustic cavity and continue to produce a variety of different acoustic signals until the liquid is no longer present.

By way of a third example, a screen element may be configured in a hydrophobic state when liquid is not present in the acoustic cavity to prevent liquid from entering the acoustic cavity. Detection of liquid in the acoustic cavity may alter the screen element to a hydrophilic state to aid in removal of the liquid from the acoustic cavity and trigger an acoustic membrane to produce an acoustic signal to drive the liquid from the acoustic cavity through the newly hydrophilic screen element.

By way of a fourth example, the method 400 may utilize a variety of liquid removal mechanisms in attempting to remove liquid from the acoustic cavity. In some cases, detection of liquid in the acoustic cavity may first trigger an attempt to remove the liquid by causing an acoustic membrane to produce one or more acoustic signals to drive the liquid from the acoustic cavity. If after such attempt liquid is still present in the acoustic cavity, one or more heater elements may produce heat to aid in evaporation of the liquid. In such a case, heat that may be detectable by a user may be resorted to only after attempting to remove liquid from the acoustic cavity via production of acoustic signals.

By way of a fifth example, detection of liquid in the acoustic cavity may first trigger an attempt to evaporate the liquid by producing heat utilizing one or more heater elements. If after such attempt liquid is still present in the acoustic cavity, the liquid may be removed by causing an acoustic membrane to produce one or more acoustic signals to drive the liquid from the acoustic cavity. In such a case, sound that may be audibly detectable by a user may be resorted to only after attempting to remove liquid from the acoustic cavity via heating.

By way of a sixth example, detection of liquid in the acoustic cavity may first trigger an attempt to remove the liquid by causing an acoustic membrane to produce one or more acoustic signals outside the acoustic range audible to humans to drive the liquid from the acoustic cavity. If after such attempt liquid is still present in the acoustic cavity, the acoustic membrane may be caused to produce one or more acoustic signals within the acoustic range audible to humans to drive the liquid from the acoustic cavity. In such a case, sound that may be audibly detectable by a user may be resorted to only after attempting to remove liquid from the acoustic cavity via production of acoustic signals that are not audibly detectable by a user.

As discussed above and illustrated in the accompanying figures, the present disclosure discloses systems, methods, and apparatuses for evacuating liquid from an acoustic space. An acoustic module, such as a microphone or speaker module, may include an acoustic membrane that vibrates to produce acoustic waves and an acoustic cavity through which acoustic waves produced by the membrane travel. A liquid removal mechanism may remove liquid from the acoustic cavity.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A wearable device, comprising:

a housing defining an acoustic port;

a speaker module coupled to the acoustic port within the housing;

a screen element positioned within the housing between the speaker module and the acoustic port that is operative to pull liquid from within the acoustic port and resist entry of the liquid from outside the acoustic port;

a non-transitory storage medium that stores instructions; and a processing unit, disposed within the housing, that executes the instructions stored in the non-transitory storage medium to cause the speaker module to produce:

a first frequency to force the liquid out of the acoustic port through the screen element; and a second frequency following the first frequency to force the liquid out of the acoustic port through the screen element; wherein:

the screen element is operative to move the liquid out of the acoustic port, in cooperation with the first frequency and the second frequency.

2. The wearable device of claim 1, wherein at least one of:

the first frequency is inaudible to humans; or the second frequency is inaudible to humans.

3. The wearable device of claim 1, wherein the processing unit causes the speaker module to produce the first and second frequencies when the wearable device is connected to an external power source.

4. The wearable device of claim 1, wherein the acoustic port comprises:

an acoustic cavity disposed within the housing; and passages extending through the housing from the acoustic cavity to an external environment.

5. The wearable device of claim 4, wherein the liquid is forced from the acoustic cavity in a same direction as human audible sound produced by the speaker module.

6. The wearable device of claim 4, wherein the passages are defined through an external surface of the wearable device.

7. The wearable device of claim 1, wherein the speaker module produces a human audible frequency after the second frequency.

8. An electronic device, comprising:

a housing defining:

an acoustic space within the housing; and passages between the acoustic space and an external environment;

a speaker module coupled to the acoustic space within the housing;

a non-transitory storage medium that stores instructions; and a processing unit, disposed within the housing, that executes the instructions stored in the non-transitory storage medium to cause the speaker module to operate in:

a first mode where the speaker module transmits sound waves within a range of human hearing; and a second mode where the speaker module produces heat and transmits a first frequency and then a second frequency to force liquid out of the acoustic space; wherein:

the first and second frequencies are outside the range of human hearing.

9. The electronic device of claim 8, wherein the sound waves within the range of human hearing are between approximately 20 Hz and 20,000 Hz.

10. The electronic device of claim 8, wherein the first and second frequencies have different acoustic characteristics.

11. The electronic device of claim 8, wherein the first and second frequencies have different amplitudes.

12. The electronic device of claim 8, wherein the passages are smaller than the acoustic space.

13. The electronic device of claim 8, wherein the first frequency and the second frequency were previously used to clear the acoustic space.

14. A wearable device, comprising:

a housing defining an acoustic port:

a speaker module coupled to the acoustic port within the housing;

a screen element positioned within the housing between the speaker module and the acoustic port;

a non-transitory storage medium that stores instructions; and a processing unit, disposed within the housing, that executes the instructions stored in the non-transitory storage medium to cause the speaker module to produce heat and a sequence of frequencies to force liquid from the acoustic port through the screen element; wherein:

the screen element is operative to cooperate with the sequence of frequencies to move the liquid from the acoustic port;

the sequence of frequencies includes two different frequencies that are outside a range of human hearing; and the processing unit causes the speaker module to produce the two different frequencies sequentially.

15. The wearable device of claim 14, wherein the processing unit causes the speaker module to produce the sequence of frequencies before producing sound that is audible to humans.

16. The wearable device of claim 14, wherein the two different frequencies are above approximately 20,000 Hz.

17. The wearable device of claim 14, wherein the two different frequencies are below approximately 20 Hz.

18. The wearable device of claim 14, wherein the processing unit causes the speaker module to produce the sequence of frequencies in a different mode than a mode in which the processing unit causes the speaker module to produce human audible sound.

19. The wearable device of claim 14, wherein the processing unit causes the speaker module to produce the sequence of frequencies after the processing unit determines the liquid is present in the acoustic port using a sensor.

20. The wearable device of claim 14, wherein the processing unit causes the speaker module to produce at least one of the two different frequencies after the processing unit determines the liquid is present in the acoustic port using a sensor.

* * * * *